United States Patent [19]

Pin-Hung et al.

[11] Patent Number: 4,878,875

[45] Date of Patent: Nov. 7, 1989

[54] NOVEL CLIMBING TOY

[76] Inventors: Lin Pin-Hung, 5F, No. 5, Lane 59, Sec. 3; Yu Kao-Hsien, Room 506, 5F, No. 54, Sec. 1 Chung Hsiao E. Road, both of Taipei, Taiwan

[21] Appl. No.: 121,110

[22] Filed: Nov. 16, 1987

[51] Int. Cl.[4] ..... A63H 11/00

[52] U.S. Cl. ..... 446/356; 446/314; 446/330

[58] Field of Search ..... 446/190, 314, 315, 330, 446/333, 335, 352, 353, 354, 355, 356, 444, 377, 489; 40/411, 414, 418

[56] References Cited

U.S. PATENT DOCUMENTS

| | | | |
|---|---|---|---|
| 545,958 | 9/1895 | Hoffmann | 446/315 |
| 637,508 | 11/1899 | Grimoin-Sanson et al. | 446/330 X |
| 1,267,608 | 5/1918 | Vaughan | 446/315 |
| 1,462,090 | 7/1923 | Lindstrom | 446/315 |
| 1,836,640 | 12/1931 | Bowman | 446/314 X |
| 3,928,933 | 12/1975 | Iwamoto | 446/330 |
| 4,177,602 | 12/1979 | Choi | 446/356 X |
| 4,245,486 | 1/1981 | Matsumoto et al. | 446/314 X |
| 4,245,515 | 1/1981 | Iwaya | 446/356 X |
| 4,512,748 | 4/1985 | Matsumoto et al. | 446/354 |

FOREIGN PATENT DOCUMENTS

| | | | |
|---|---|---|---|
| 0201626(A2) | 11/1986 | European Pat. Off. | 446/355 |
| 2500759 | 9/1982 | France | 446/355 |

*Primary Examiner*—Robert A. Hafer
*Assistant Examiner*—Sam Rimell
*Attorney, Agent, or Firm*—Leonard Bloom

[57] ABSTRACT

This invention is a climbing toy which features simple structure, life-like action and stronger attraction. Orbiting friction wheels hold clothing or other material, and the toy climbs up in the direction of moving of these wheels. A balancing is achieved with a lever which moves a convex pad on each of the hands and feet for climbing. A driving mechanism with an interior mercury switch controls the action of climbing depending upon the attitude with the aid of motion of the body.

8 Claims, 8 Drawing Sheets

NOVEL CLIMBING TOY

BACKGROUND OF THE INVENTION

This invention concerns a climbing toy.

Most climbing toys seen in market may move on the ground or other area horizontally. The "Magic Octopus" developed years ago comes down slowly with the attraction of the body of the toy to the wall. But it could not climb up. To the makers of toys who pursue novelties at all times, it should be a matter of interest.

In view of this, the applicant with much experience in the past, developed successfully this novel climbing toy after repeated experiment and improvement.

OBJECT OF THE INVENTION

The object of this invention is to supply a novel climbing toy which may climb up available clothing, or window curtain.

Another object of this invention is to provide a climbing toy which is highly attractive to the customers and children.

Still another object of this invention is to provide a novel climbing toy, the movement of which may be controlled by the attitude of the body.

This invention has another object of providing an attractive toy which climbs on the clothing of a person.

To achieve the object as above and other objects, the applicant wishes to give a better example and the figures as below for description of equipment, accessories and its effect. The terms or name adopted for the equipment and accessories are used for the convenience in description only. They should be not limited to actual meanings.

DESCRIPTION OF THE PREFERRED EMBODIMENT

Figure 1:
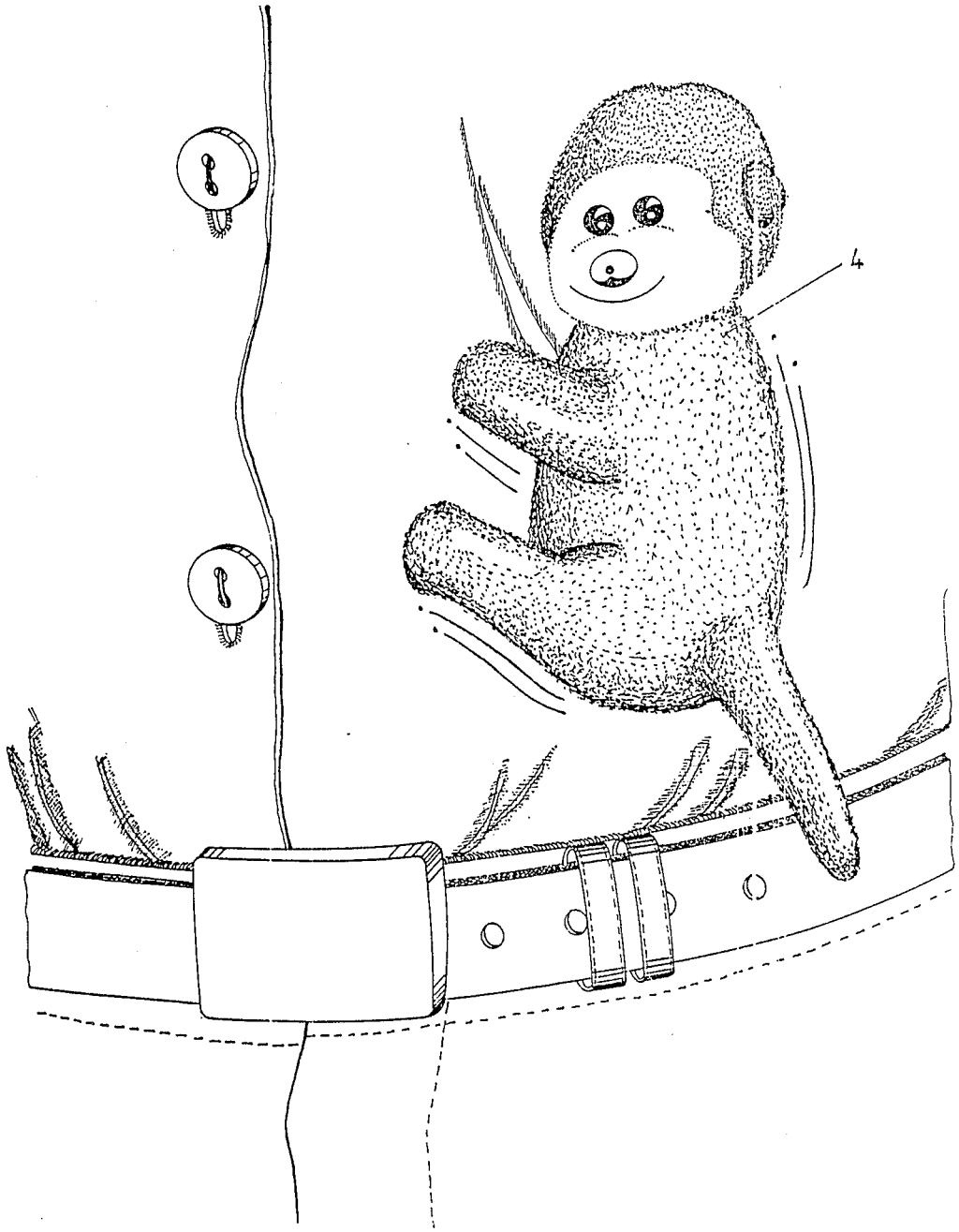
FIG. 1. A perspective view showing the toy climbing on the shirt of a person.
Figure 2:
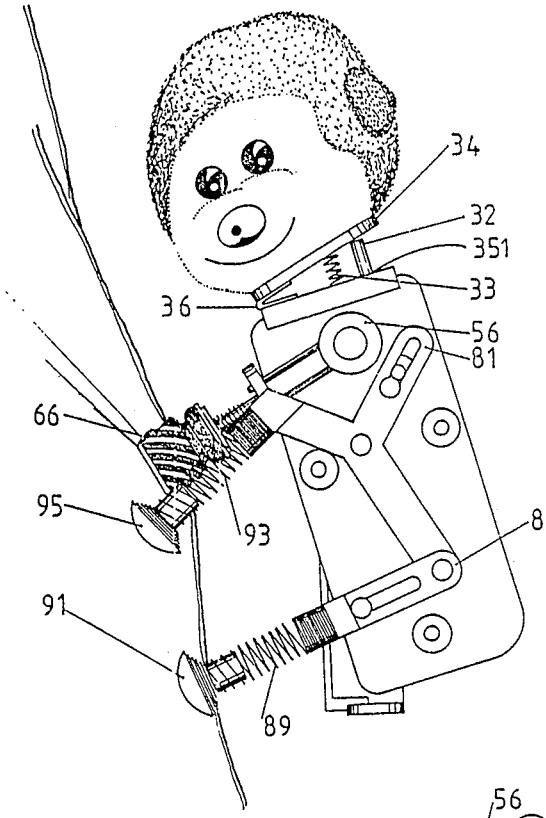
FIG. 2. The side view of the toy with the cover removed, showing the motion of the head and arms and legs when the toy of this invention climbs.
Figure 3:
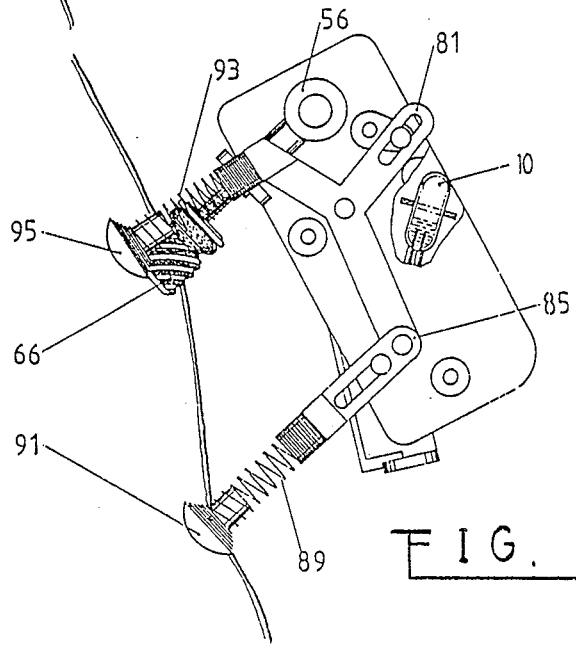
FIG. 3. The side view of the toy with the cover and head removed, showing the motion of arms and legs when the toy of this invention climbs and the attitude of the mercury switch.

This invention provides a kind of novel climbing toy (please refer to FIGS. 1, 4, 7, 8 and 12) consisting of a motor controlled circuit 9, driving mechanism 1, wheel climbing mechanism 5, limb climbing mechanism 8 and a cover 4. The motor controlled circuit 9 supplies power to motor 11. The driving mechanism 1 is a transmitter of the power of this invention moved by the motor 11. The wheel climbing mechanism 5 is located at the top of rear side of the driving mechanism, which, moved by the driving mechanism 1, makes the friction wheels 66 & 67 turn around (orbit) with each other in opposite directions. The limb climbing mechanism 8 is located at two sides of the driving mechanism, and when moved by the driving mechanism 1, enable the convex pads 94 & 95 of the hands and the convex pads 90 & 91 of the feet to climb up. The cover 4 is used to conceal the driving mechanism 1 of motor controlled circuit, wheel climbing mechanism 5 and the limb climbing mechanism 8. It may be changed into different designs to achieve variety and beauty.

Figure 12:
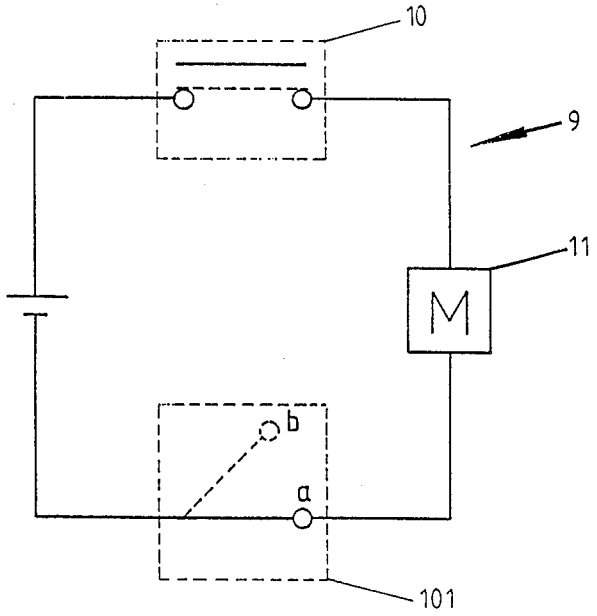
FIG. 12. Motor controlled circuit of this climbing toy to show automatic cut-off of the mercury switch when the toy is in an attitude for falling down.
Figure 13:
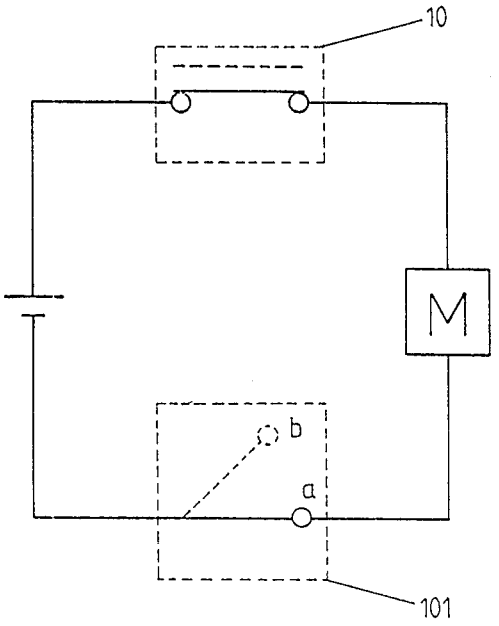
FIG. 13. Motor controlled circuit of this climbing toy to show the mercury switch closed when the toy is in a substantially upright position.

(1) Motor controlled circuit:

Please refer to FIGS. 12 and 13. This motor controlled circuit consists of a motor 11; mercury switch 10 and a manual switch 101. When the manual switch 101 is placed on b, the circuit is open, and the motor 11 will not operate. But when the switch 101 is set on a, the circuit will be under the control of mercury switch 101. As shown on FIG. 12, when the body is angled during climbing, the circuit of mercury switch 10 is made to open. This invention will stop climbing and the toy will remain in its place. But when the body is upright, the circuit of mercury switch 10 is closed again to enable the toy continue climbing. By this way, the climbing or stopping can be controlled by the attitude of the body to add more novelty and interest.

(2) Driving mechanism

Figure 4:
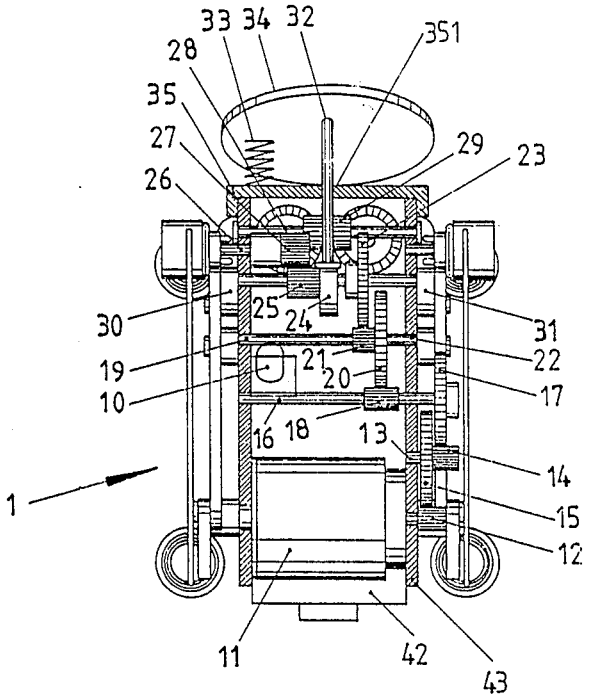
FIG. 4. The back view of the toy, showing the interrelation of the driving mechanism.
Figure 11:
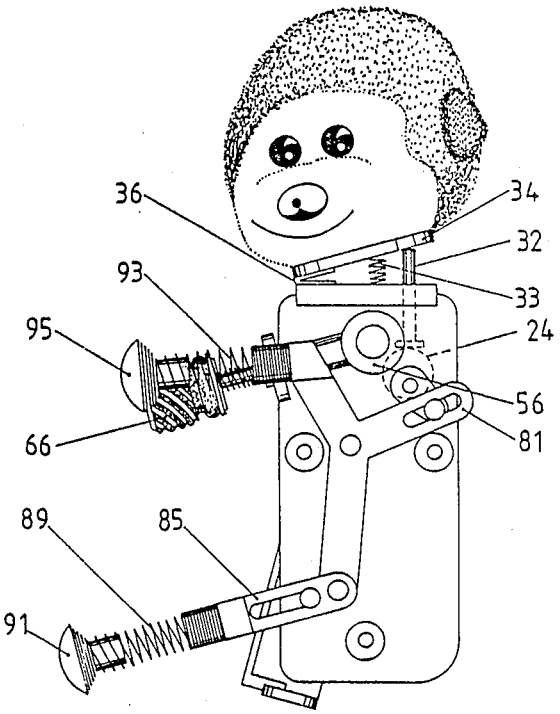
FIG. 11. The side view of the climbing toy, showing the cam wheels to move the head and the limbs for climbing.

Please refer to FIG. 4. The base 43 is a "U" shape which is formed by a plate 41 connected to the battery cell, cabinet 42. The motor 11 is fixed in the side wall of base 43 with a small gear 12 connected to the axle of the motor 11. The first driving gear 14 and first given gear 15 are fixed on the axle 13 which is supported on the base 43. The first driven gear 15 is moved by the small gear 12. The second driving gear 18 and second driven gear 17 are fixed on the axle 16 which is also supported on the base 43. The second driven gear 17 is moved by first driving gear 14. Third driving gear 21 and third driven gear 20 are fixed on the axle 19 which is also supported on the base 43. The third driven gear 20 is moved by second driving gear 18. Fourth driving gear 25, fourth driven gear 23, cam wheel 24, cam wheel 30 and cam wheel 31 are all fixed on the axle 22 which is also supported on the base 43. The fourth driven gear 23 is moved by third driving gear 20. The idle gear 27 is fixed on the axle 26 which is supported on the base 43. The idle gear 27 is moved by fourth driving gear 25. The idle gear 29 is fixed on the axle 28 which is supported on the base 43. The idle gear 29 is moved by the idle gear 27. With reference to FIG. 11, the panel 35 is fixed on the base 43 and has a hole 351 in its middle part. The circular plate 34 is in round shape and connected to the top panel 35 with the cloth 36 and spring 33 in a movable state. A pushing bar 32 is in nail shape with its head on cam wheel 24 and the body of the bar movable up and down in the hole 351 to move the circular plate 34. This causes the head of the toy to move up and down.

When the motor 11 operates, the power transmits through small gear 12, first driven gear 15, first driving gear 14, second driven gear 17, second driving gear 18 to third driven gear 20, third driving gear 21, and again through fourth driven gear 23, fourth driving gear 25, cam wheel 24, cam wheel 30 and cam wheel 31, and with the power of cam wheel 24, move the pushing bar 32 up and down thus moving the board 34 up and down. The power may be transmitted through the cam wheel 30 and the cam wheel 31 to move the limb climbing mechanism 8 for climbing. The power through fourth drive gear wheel 25 may be transmitted from the idle gear 27 to the idle gear 29 to move the wheel climbing mechanism 5 for climbing upward.

(3) Wheel climbing mechanism

Figure 5:
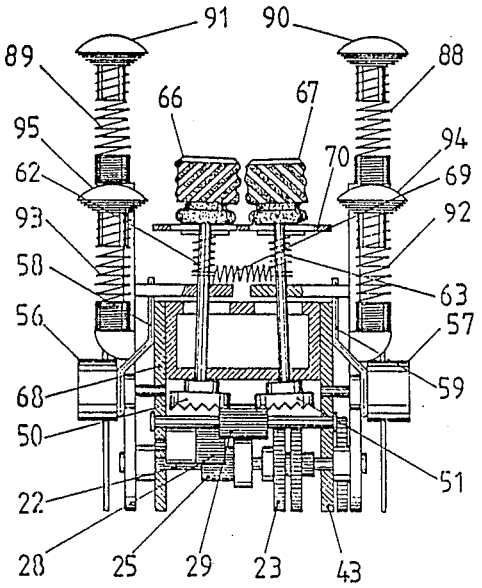
FIG. 5 The top view of the toy, showing the interrelation of the climbing mechanism.
Figure 6:
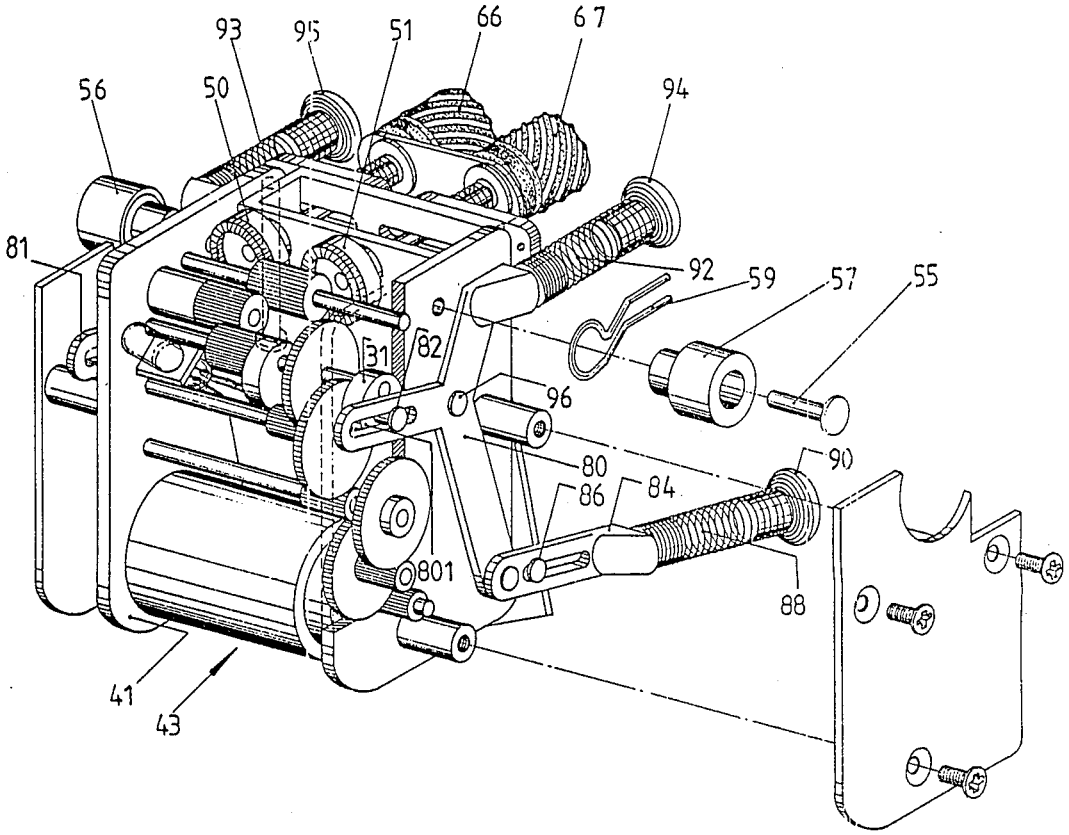
FIG. 6. A partially exploded perspective view of the back and right side of the toy showing the interrelation of the driving and climbing mechanisms.
Figure 7:
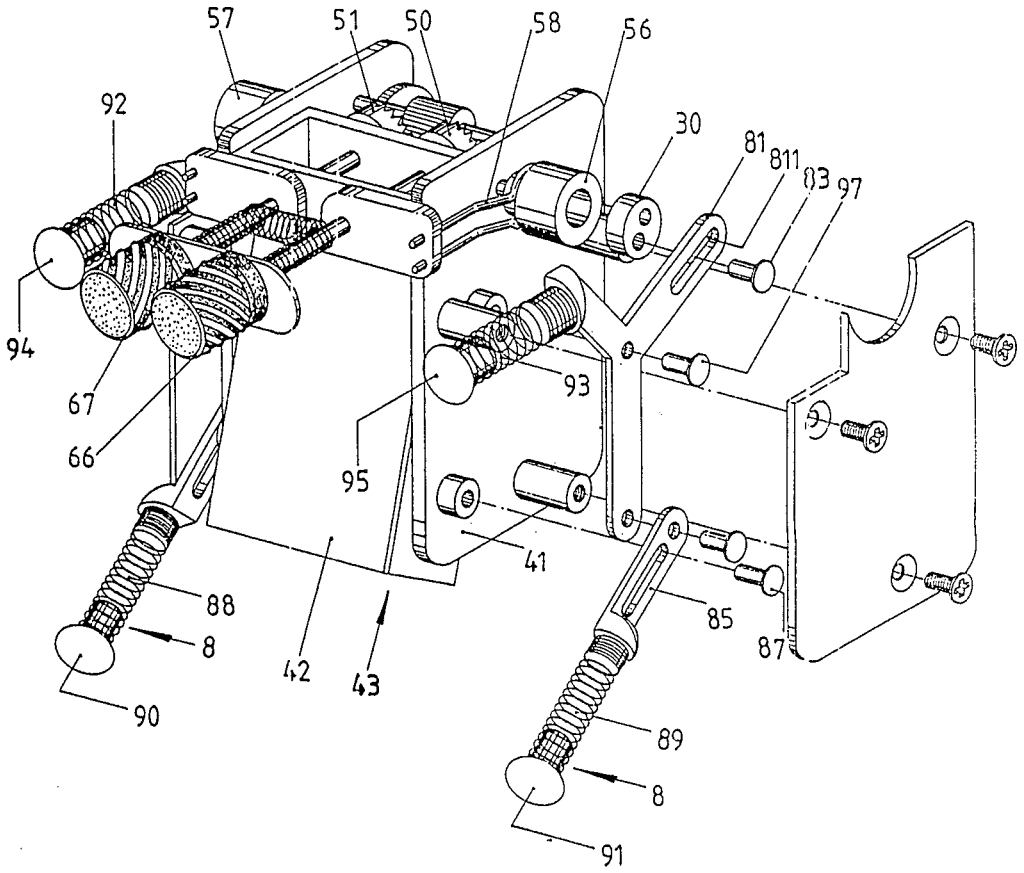
FIG. 7. A partially exploded perspective view of the front and left side of the toy, showing the limb climbing mechanisms.
Figure 8:
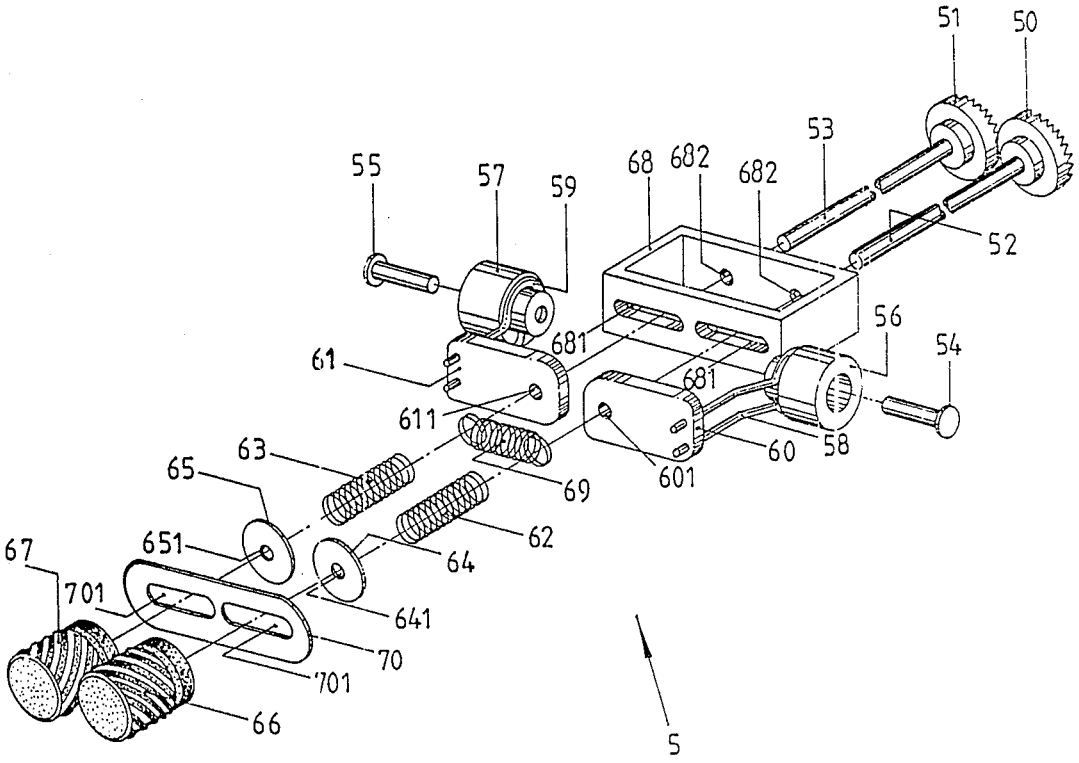
FIG. 8. An exploded view of the wheel climbing mechanism.
Figure 9:
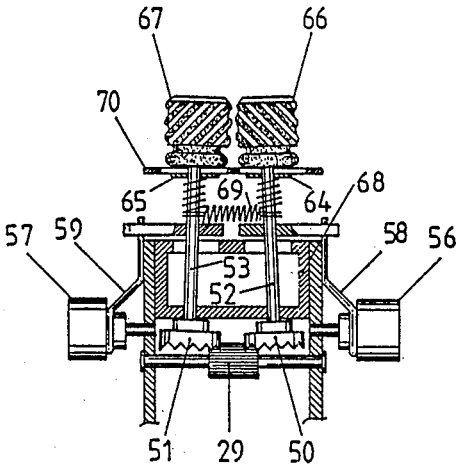
FIG. 9. A top view of the wheel climbing mechanism of this climbing toy showing the operation of the two orbiting friction wheels.
Figure 10:
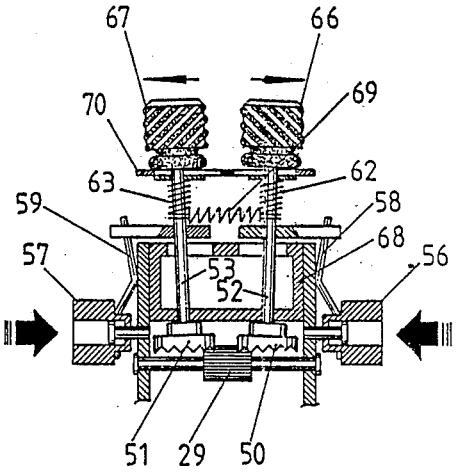
FIG. 10. A top view of the wheel climbing mechanism of this climbing toy showing the movement of two orbiting friction wheels to permit grasping of material.

Please refer to FIGS. 5 and 8. The base box 68 is a hollow cuboid body with front side having two penetrating slots 681 and rear side having two penetrating holes 682. The two yoke carriers 56 & 57 are in a hollow cylinder shape which, with pin 54 and pin 55, are connected to the base 43. The two yokes 58 & 59 are "U" shaped and are engaged on the inner sides of the yoke carriers 56 & 57. The two pulling boards 60 & 61 are in rectangle shape with internal sides having holes 601 & 611 respectively and outer sides connecting to the front part of yokes 58 and 59. The clamp board 70 is oval shaped with a middle part having two slots 701. The two orbiting friction wheels 66 & 67 are in hollow cylinder shape with outer side having several grooves to add the friction strength during the climbing. Fifth driving gear 50 and sixth driving gear 51 are separately fixed on the side of axle 52 and axle 53. The other side of both axles penetrate in order into two holes 682, two grooves 681, hole 601 & 611, both ends of transverse spring 69, springs 62 & 63, the holes 641 & 651 of washers 64 & 65, two slots 701 of clamping board 70, and finally are encased into the interior of two orbiting friction wheels 66 & 67. After assembly of the wheel climbing mechanism (please refer to FIG. 9), the space between its two friction wheels can tightly clamp on the clothing or other fabric to enable this invention to climb upward without falling down. When the wheel climbing mechanism is going to clamp on the clothing or other fabric (please refer to FIG. 10), it presses down the yoke carriers 56 & 57, and with the pull of the yokes 58 & 59, two orbiting friction wheels 66 & 67 are extended outward to increase the space between two orbiting friction wheels for effective clamping.

When the idle gear 29 moves, it may move the fifth driving gear 50 and sixth driving gear 51 of the wheel climbing mechanism 5, which is transmitted to the orbiting friction wheels 66 & 67 so that the wheels orbit to enable the toy climb up in the direction of moving of the orbiting friction wheels 66 & 67.

(4) Limb climbing mechanism:

Please refer to FIGS. 2, 3, 6, 7 and 11. The "Y" shaped levers 80 & 81 are pivotally mounted to the outer side of the base 43 with each base leg of the lever having a slot 801 & 811 respectively and each upper arm of the lever connected with the spring 92 and spring 93. The two slots 801 & 811, match pins 82 & pin 83 respectively, and, are each connected with the cam wheel 31 & the cam wheel 30 respectively. The end of the connecting bars 84 & 85 for the two feet of the toy are pinned to the lower part of the levers 80 & 81 and other ends engage fixed spring 88 & spring 89 respectively. The middle part of each connecting bar 84, 85 has a slot, and with the pin 86 & pin 87, controls the direction of motion. The connecting bars 84 & 85 for the feet of the toy are driven by the articulation of the levers 80 & 81 to enable the invention climb up, articulating forward and backward periodically. In the meantime the clutching angle between the orbiting friction wheels 66 & 67 and clamped clothing or other fabric, is adjusted preventing the toy from falling down because of gravity. The convex pads 90 & 91 are located at the other end of spring 88 & spring 89, and with the friction between them and the clothing or other fabric so clamped, the climbing can be done accordingly. The convex pads 94 & 95 of two hands are at other ends of spring 92 & spring 93, and with the friction between them and the things so clamped, climbing can be done also.

When the cam wheel 31 and cam wheel 30 move, it may, with the pin 82 & pin 83, move the levers 80 & 81 to enable the convex pads 94 & 95 of the hands, the convex pads 90 & 91 of the feet to climb continuously. This climbing motion may periodically support this toy to enable the grasp between the wheel climbing mechanism and the clothing or other fabric so clamped, to be kept in an attitude for climbing upward, so that the toy will not fall down.

(5) Cover:

Please refer to FIG. 1. The cover 4 is designed for the beauty and also for novelty. A monkey is illustrated herein, but it is appreciated that the appearance of the instant invention can be modified as desired. For example, the toy may be in the form of a cat, chimpanzee, superman, etc.

Thus, the instant invention made of above members (1) a motor controlled circuit, (2) a driving mechanism, (3) a wheel climbing mechanism, (4) a limb climing mechanism and (5) a cover. When the motor starts, the driving mechanism 1 moves the wheel climbing mechanism 5 for climbing while the limb climbing mechanism 8 move complementarily. After the wheel climbing mechanism receives power, it may climb immediately through the orbiting friction wheels 66 & 67 which clamp on the clothing or other fabric and turn in opposite directions. After the limb climbing mechanism 8 receives the power, it may move the convex pads 94 & 95 of the hands, the convex pads 90 & 91 of the feet through the levers 80 & 81 for complementary climbing and periodically support this toy. Such a supporting motion enables readjustment of the grasp between the oribiting friction wheels 66 & 67 and the objects so clamped on to make these wheels climb upward further and also achieve more balance. During the climbing, the motion of climbing may be controlled by the attitude of the body for more interesting effects.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A climbing toy animal having a body and limbs, the climbing toy animal being intended to climb up a fabric, such as the clothing worn by a person, comprising:

a motor disposed within the body;

a source of power to energize the motor;

a means for moving the limbs to simulate climbing; and a climbing mechanism driven by the motor and including means which alternately clamp and release the person's clothing, thereby enabling the toy animal to climb up the person.

2. The climbing toy animal of claim 1, wherein the climbing mechanism comprises two rotating friction wheels rotatable in opposite directions, the wheels being laterally movable with respect to one another to increase and decrease the space therebetween, such that the rotating friction wheels clamp the fabric to produce a climbing movement, and such that the toy may climb continuously and independently.

3. The climbing toy animal of claim 2, wherein the orbiting friction wheels have grooves formed thereon to increase the friction between the wheels and the fabric, such that climbing ability is improved.

4. The climbing toy animal of claim 1, each limb further comprising a convex pad connected to a spring, the spring connected to a lever, the lever pivotally mounted to a base and the lever actuated to move in a forward and backward motion by a cam, the cam in communication with a plurality of gears and axles and driven by the motor contained within the base, such that energizing the motor results in a backward and forward movement of the limbs in an alternating manner to simulate a climbing movement.

5. The climbing toy animal of claim 1, further comprising an on/off manual switch connected in electrical series with the source of power for the motor, such that the on/off manual switch activates and deactivates the motor; and a mercury switch connected in electrical series with the on/off manual switch and the source of power for the motor, such that the mercury switch is in a closed position when the toy is in a substantially upright position and the toy climbs; and wherein when the attitude of the toy is such that the mercury switch is in an open position, the climbing of the toy is stopped, such that the toy does not fall from the fabric on which it climbs.

6. The combination of claim 1, wherein the climbing toy animal comprises a climbing toy monkey.

7. The climbing toy animal of claim 1, further including a head on the body, and means for moving the head during climbing.

8. A climbing toy animal having a body, a head and limbs, comprising:

a motor disposed within the body;

a source of power to energize the motor;

an on/off manual switch connected in electrical series with the source of power for the motor such that the on/off manual switch activates and deactivates the motor, and a mercury switch connected in electrical series with the on/off manual switch and the source of power for the motor such that the mercury switch is in a closed position when the toy is in a substantially upright position and the toy climbs, and wherein, when the attitude of the toy is such that the mercury switch is in an open position, the climbing of the toy is stopped, such that the toy does not fall when it climbs;

a climbing mechanism driven by the motor including a pair of rotating friction wheels such that, in a climbing movement, the toy may alternately clamp and release fabric, such as the clothing of a person;

the two rotating friction wheels having grooves formed thereon and rotatable in opposite directions, the wheels being laterally movable with respect to one another to increase and decrease the space therebetween such that the orbiting friction wheels clamp the fabric to produce a climbing movement and such that the toy may climb continuously and independently;

a means for moving the head and the limbs to simulate climbing, each limb further comprising a convex pad connected to a spring, the spring connected to a lever, the lever pivotally mounted to a base and the lever actuated to move in a forward and backward motion by a cam, the cam in communication with a plurality of gears and axles and driven by the motor contained within the base such that energizing the motor results in a backward and forward movement of the limits in an alternating manner to simulate a climbing movement; and a cover in the form of an animal, the appearance of which may be modified as desired.

* * * * *